United States Patent [19]

Everett et al.

[11] Patent Number: 4,951,756

[45] Date of Patent: Aug. 28, 1990

[54] TORQUE CONTROL SCREWDRIVER

[75] Inventors: Richard J. Everett, New Hartford; David A. Giardino, Utica; William K. Wallace, Barneveld, all of N.Y.

[73] Assignee: Chicago Pneumatic Tool Company, Utica, N.Y.

[21] Appl. No.: 352,270

[22] Filed: May 16, 1989

[51] Int. Cl.[5] ..... B25B 23/14

[52] U.S. Cl. ..... 173/12; 192/56 R; 192/150

[58] Field of Search ..... 173/12; 192/150, 56 R

[56] References Cited

U.S. PATENT DOCUMENTS

| | | | |
|---|---|---|---|
| 2,964,151 | 12/1960 | Eckman | 192/0.034 |
| 3,082,742 | 3/1963 | Vilmerding et al. | 121/11 |
| 3,174,599 | 3/1965 | Spyridakis et al. | 192/56 |
| 3,205,986 | 9/1965 | Kramer | 192/56 |
| 3,205,992 | 9/1965 | Clapp | 192/150 |
| 3,263,785 | 8/1966 | Krouse | 192/150 |
| 3,275,116 | 9/1966 | Martin | 192/150 |
| 3,477,521 | 11/1969 | Kiester | 173/12 |
| 3,608,686 | 9/1971 | Martin Sr., et al. | 192/150 |
| 3,667,345 | 6/1972 | Schaedler et al. | 91/39 |
| 3,766,990 | 10/1973 | Eckman et al. | 173/12 |
| 3,850,553 | 11/1974 | Wallace | 418/43 |
| 4,071,092 | 1/1978 | Wallace | 173/12 |

FOREIGN PATENT DOCUMENTS

| | | | |
|---|---|---|---|
| 2064682 | 6/1981 | United Kingdom | 192/56 |

*Primary Examiner*—Frank T. Yost
*Assistant Examiner*—Scott A. Smith
*Attorney, Agent, or Firm*—Charles L. Johnson, Jr.

[57] ABSTRACT

A hand held pneumatic tool is provided for driving fasteners in which the cam shape and arrangement between the driving and driven cams provides a "dwell" time for preventing further impacts after the desired torque has been reached and a latch arrangement provided to prevent undesired shut-off in the reverse direction of operation. Means are provided to assure restart after shut-off, and a ball spline between the driven cam and spindle is used to increase accuracy.

4 Claims, 5 Drawing Sheets

34
29
40
6
12
1
15
30
16
17
18
39
25
19
20
21
7
14
8
10
9
2
3
4
5
31

37
36
35
33
32
34

FIG. 8
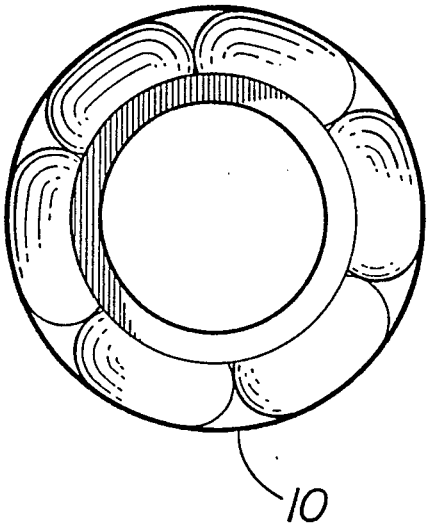
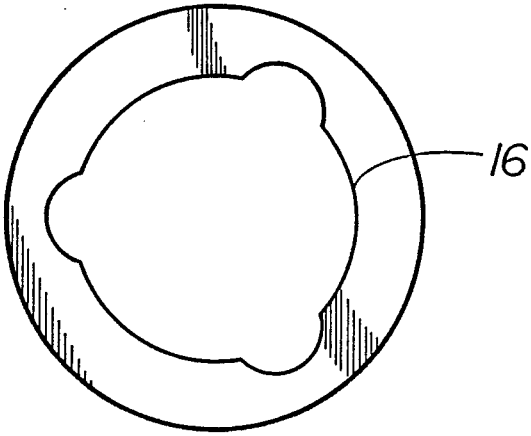
FIG. 9
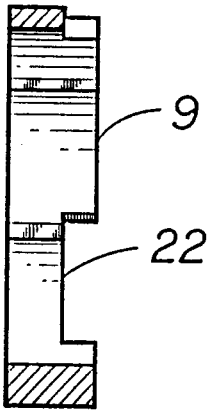
A-A
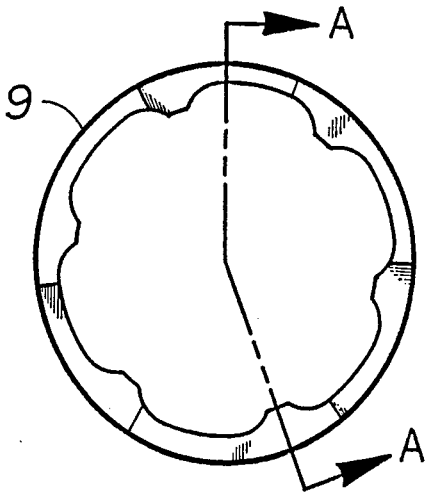
FIG. 10

TORQUE CONTROL SCREWDRIVER

BACKGROUND OF THE INVENTION

1. Field of the invention:

This invention relates to torque control for the automatic shut-off of pneumatically powered handheld tools.

2. Description of the Prior Art:

A type of tool having automatically operable shut-off means is found in U.S. Pat. No. 3,667,345, which tool incorporates a pneumatically balanced air flow control valve. Another type, using a centrifugally responsive ball valve, is disclosed in U.S. Pat. No. 3,850,553. A tool using a push rod operable at a predetermined torque to close an air inlet valve in response to a ball which is forced up a cam ramp when the predetermined torque is realized can be found in U.S. Pat. No. 4,071,092.

SUMMARY OF THE INVENTION

The device of the present invention represents improvements over the above-noted prior art devices in the use of a rolling ball spline and rolling ball cams and in that a unique cam actuator is used to provide a time dwell in the forward direction to prevent the clutch balls from impacting on a driven jaw after triggering a shutoff and before the motor drops to a lower energy level without impacting additional torque. Also, a latch is provided in the reverse direction to prevent the tool from shutting off prematurely. Also, means are provided to prevent shut-off in a position that would prevent restarting.

BRIEF DESCRIPTION OF THE DRAWINGS

FIGS. 1A and 1B are a partial cross section of the torque control screwdriver.

FIG. 8 is a cross-sectional view of the driver cam.

FIG. 9 is a cross-sectional view of the driven cam.

FIG. 10 is a cross-sectional view of the actuator cam.

DESCRIPTION OF THE INVENTION

Figures 1, 2:
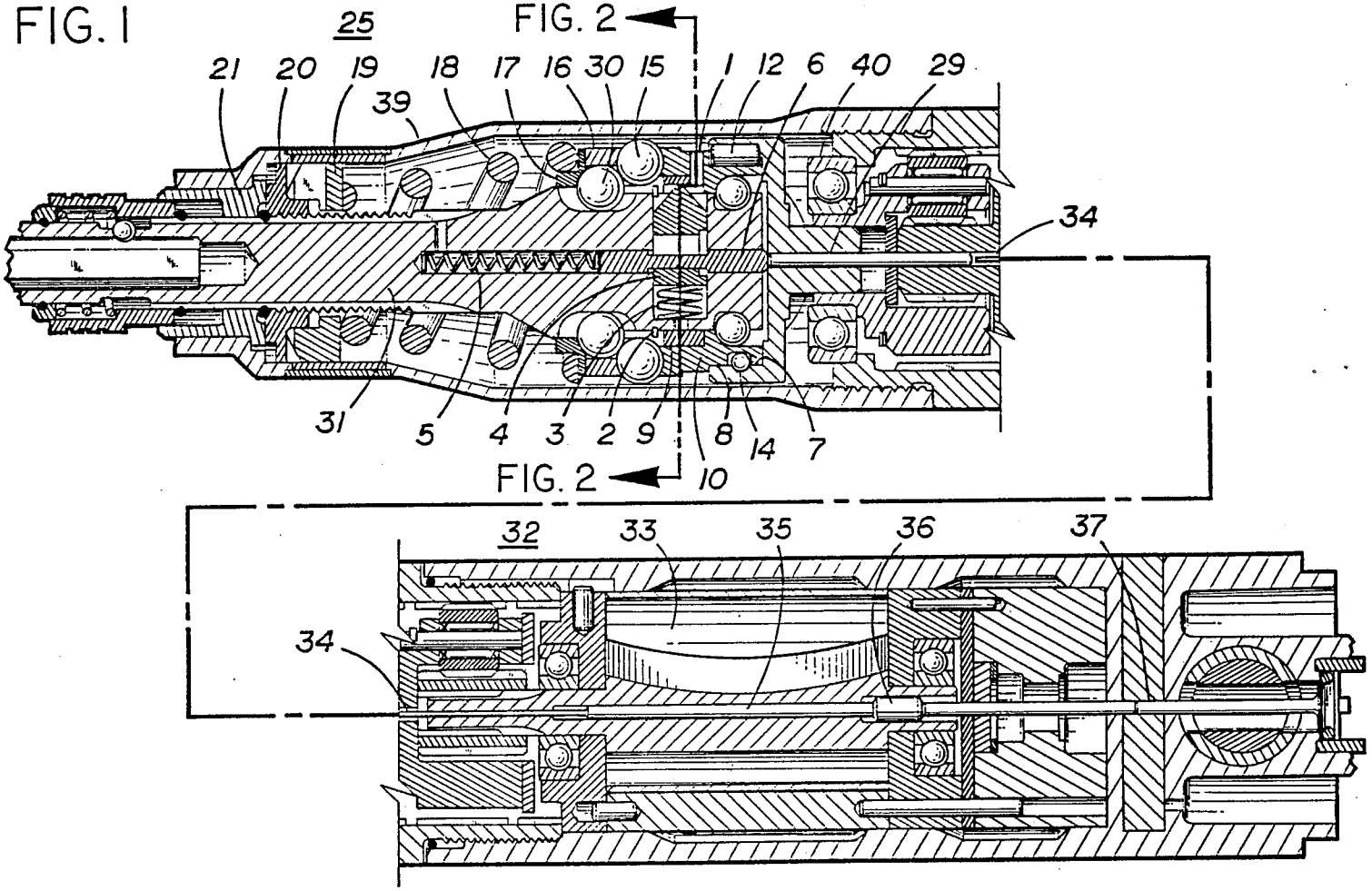
FIG. 2 is a cross sectional view of FIG. 1, taken along 2—2.
Figure 3:
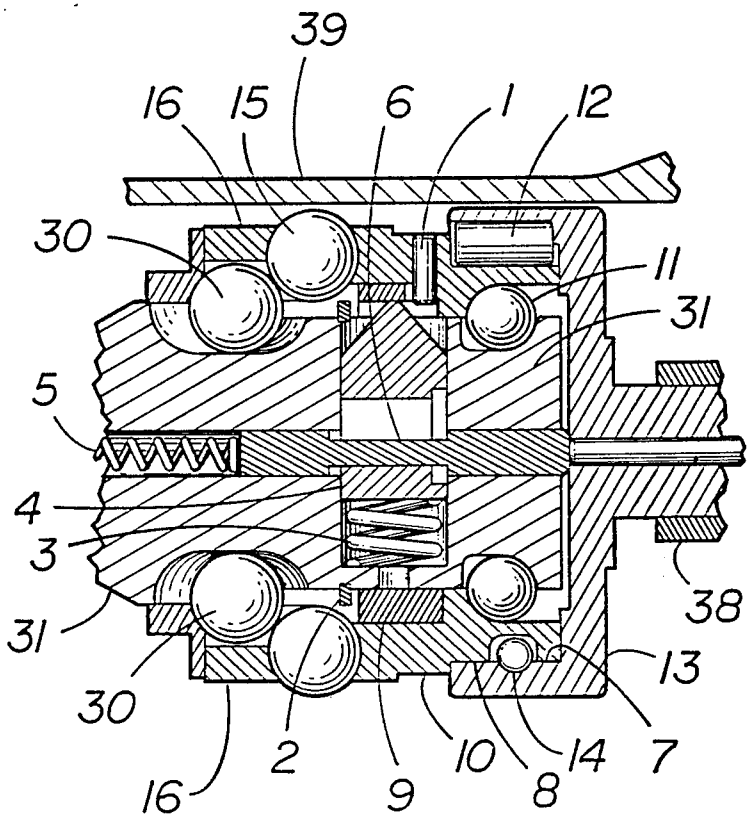
FIG. 3 is an isolated expanded view of the portion of FIG. 1 showing the actuator cam.
Figure 2:
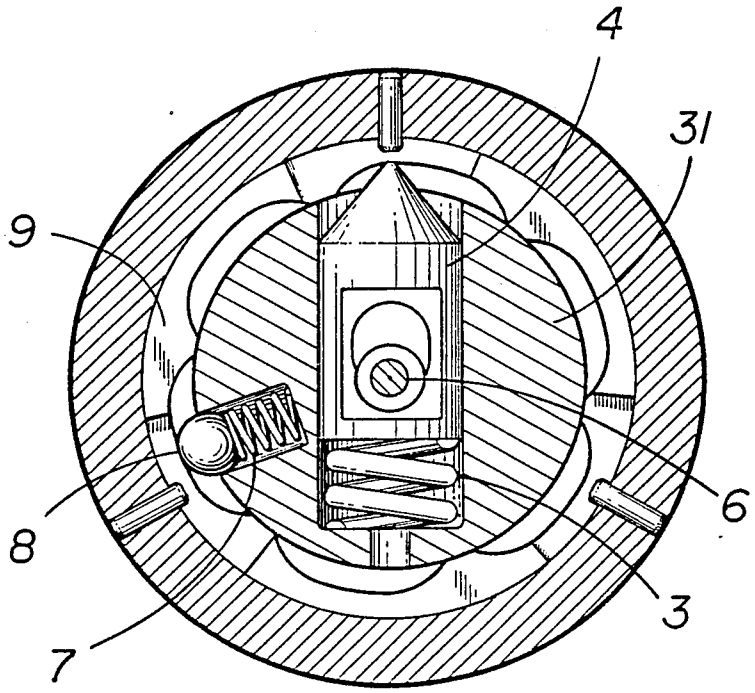
Figure 5:
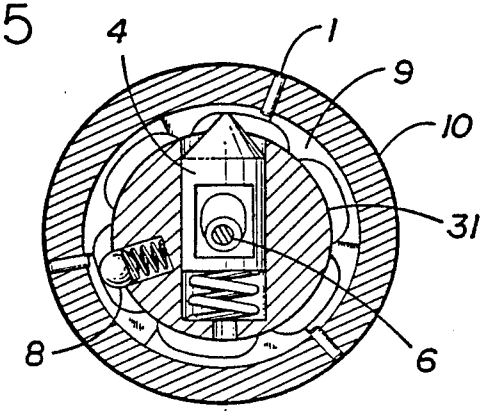
FIG. 5 is a cross-sectional view, including the actuator cam, in the forward mode of operation.
Figure 7:
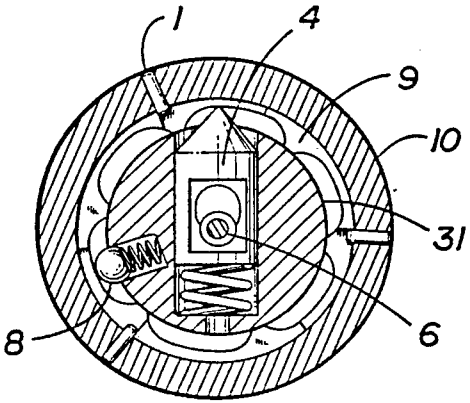
FIG. 7 is a cross-sectional view, including the actuator cam, in the reverse mode of operation.

The torque control screwdriver will now be described by reference to the figures. Numeral 25 indicates a fastener setting tool embodying the principles of the invention, the illustration being foreshortened to satisfy drawing space requirements, the portion omitted being a vane type pneumatic motor as used in such tools and well known in the art. The tool is enclosed in the housing 39. The motor drives gearing connected to a clutch to rotate a toolholding spindle. The invention is directed to an improved clutch.

Referring to FIGS. 1A and 1B, the motor driven gear spindle 38 is connected to the drive coupler 13. The drive coupler 13 is radially supported by the gear spindle 38 but is free to move axially relative to the gear spindle 38. The driving cam 10 has an outer diameter portion 8 that fits closely into the inner diameter 7 of the drive coupler 13 and is secured to drive coupler 13 by two pins 12 and 14. Pin 12 secures the driving cam 10 angularly while pin 14 retains the driving cam 10 axially.

The output spindle 31 has means to accept and retain a bit (not shown) used to drive a threaded fastener at one end. This end of output spindle 31 is radially piloted to the clutch housing 39 by bushing 21, but is free to rotate and move axially relative to the clutch housing 39. The other end of output spindle 31 is radially supported to the driver cam 10 by balls 11.

The driven cam 16 is angularly connected to the output spindle 31 by three equally spaced balls 30 which fit into axial grooves in the inner diameter of the driven cam 16 and the outer diameter of the output spindle 31. Driven cam 16 is free to move axially relative to output spindle 31.

Cam actuator 9 fits into the inner diameter of a portion of the driver cam 10 and is retained by ring 2. Cam actuator 9 is free to rotate within the confines of driver cam 10. Three pins 1 are equally spaced and are pressed into the driving cam 10 and limit the degrees of free rotation of cam actuator 9 due to the slots 22 and in the cam 9 allowing the cam 9 to rotate until the wall of the slot 22 impacts a pin 1.

Spring 3 and plunger 4 fit freely in a radial diameter of the output spindle 31.

Lock pin 6 and spring 5 fit freely in an axial diameter of output spindle 31 and are the means by which spring 3 and plunger 4 are retained. Lock pin 6 has two diameters, the smaller diameter contacting a flat on the surface of plunger 4 to prevent the lockpin 6 from moving to the output spindle end of the tool.

Load spring 18 fits between the driven cam 16 and the adjusting nut spring support 19 which is adjusted axially by the adjusting nut 20, being piloted at the driven cam 16 end by spacer 17, and the output spindle 31 at the nut end.

Operationally, the clutch receives the driving torque from the conventional air motor 33 and gearing 32.

As seen by FIGS. 1A and 1B, when the tool 25 contacts a fastener and the operator pushes the tool forward the entire clutch assembly slides to the back of the tool until the drive coupler 13 contacts the inner race of bearing 40 causing control rods 29, 34, 35 and 36 to also slide to the back of the tool and open air inlet valve 37. When the air inlet valve 37 is opened, live air can enter the air motor 33 and thereby supply the driving torque to the clutch by way of gearing 32.

The output spindle 31 receives the driving torque from the motor and gearing through input spindle drive coupler 13, pin 12, driving cam 10, balls 15, driven cam 16 and ball spline 30.

As the fastener is tightened and the torque on the fastener is increasing, balls 15 begin to climb driver cam 10 and driven cam 16. Since the initial slope of both cams is identical the balls 15 roll up each incline causing the cams 10 and 16 to separate. This separating action is resisted by load spring 18. Adjusting nut 19 20 and adjusting nut spring support is used to adjust the load on cams 10 and 16 by compressing load spring 18. The balls 11 are used to retain the driving cam 10 to output spindle 31 and serve as a low friction bearing for the cam 10 and close the load loop of spring 18 back to the output spindle 31.

The adjusting nut 20 allows the operator to change the torque output of the tool, the more load that spring 18 applies to the cams, the higher the output torque will be.

Continuing with the operation, the balls 15 continue to roll up each cam surface until they cross onto the lower slope portion of driving cam 10. At that point the maximum torque for that particular clutch setting has been delivered. The load from spring 18 can no longer resist the separating force of cams 10 and 16 since the mechanical advantage of the cams has increased due to the slope change.

Figure 4:
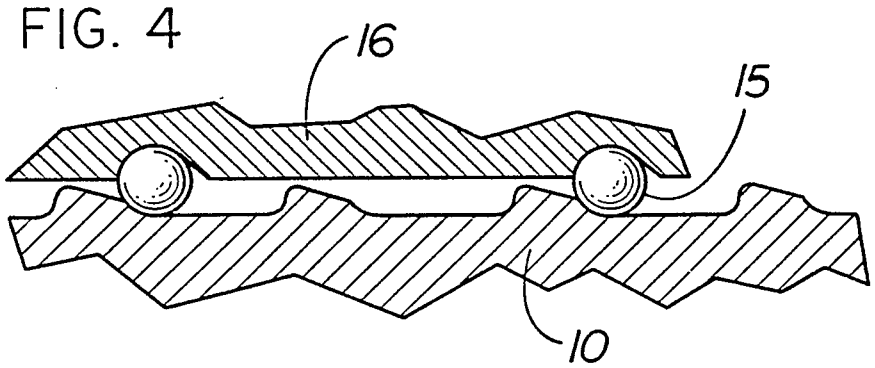
FIG. 4 is a linear representation of the circular positions of the balls relative to the driver and driven cams in the forward mode of operation.
Figure 6:
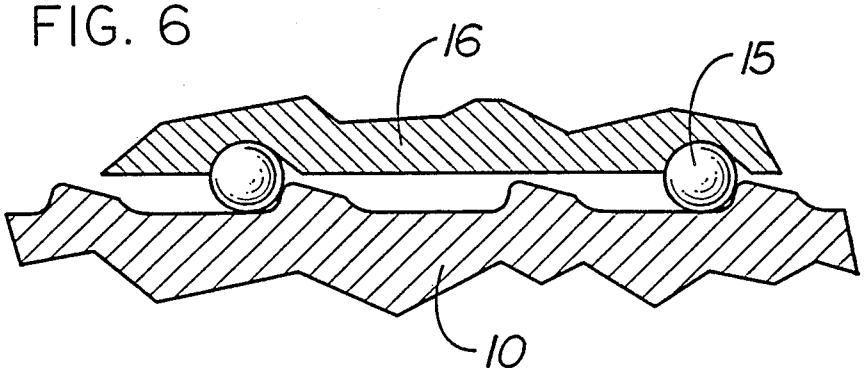
FIG. 6 is a linear representation of the positions of the balls relative to the driver and driven cams in the reverse mode of operation.

As may be seen from FIG. 4, as the balls roll over the radius connecting the high and low slopes of the ball pockets on cam 10, the slope is incrementally changed from the high to low slope value. The slope on the driven cam 16 was not decreased by this action. At some point the slope mismatch between the cams will exceed the friction angle. At this point balls 15 will be pushed or "squirted" back to the bottom of the cam pocket of the driven cam 16. Balls 15 now skid over the crest of driving cam 10 and rotate to the next set of ball pockets.

At this time cam actuator 9 rotates, being moved along by pins 1, displacing plunger 4 to shut off the tool by closing the air inlet valve 37. This happens due to the displacement of plunger 4 permitting the larger diameter of lockpin 6 to pass through the slot of plunger 4 and move control rods 29, 34, 35 and 36 and allow air inlet valve 37 to slide forward and shut off the tool.

It should be noted that the balls 15 are allowed to crest the cam of the driving cam 10 and move from one ball pocket to another. This does not happen with respect to the driven cam 16. As may be seen from FIG. 8 the driver cam has six cam surfaces and six ball pockets. FIG. 9 illustrates the driven cam to have three cam surfaces and three ball pockets.

As may be seen from FIG. 4, the initial portion of each cam surface is identical. The symmetry of these surfaces causes a pure rolling action of the balls to occur between the cams. This rolling action is important since it provides low and consistent frictional losses contributing to consistent results.

The output torque of the clutch may be expressed as Output Torque equals spring load times ball cam radius times cam slope. Once the cam surface generation reaches the desired slope to provide the necessary torque output, the slope on the cam driver is decreased with respect to the driven cam until the slope mismatch causes the balls 15 to "squirt" back into the ball pocket of the driven cam 16, while the balls 15 are cresting the cam of the driving cam 10.

As seen in FIG. 2, ball 8 and spring 7 prevent actuator cam 9 from coming to rest in a position which might prevent the tool from resetting. Ball 8 and spring 7 keep plunger 4 located in the "valley" portion of actuator cam 9 between tool cycles. If actuator cam 9 were to come to rest and cause plunger 4 to be depressed, the lockpin 6 would remain unlocked and not allow the throttle valve to open when the tool is placed against a fastener.

The clutch is reset by the action of springs 3 and 5. When the tool is removed from the work, the clutch slides forward and the small diameter of the lockpin 6 enters the plunger 4 allowing it to return and again secure pin 6.

As may be seen from FIGS. 4 and 8 the driving cam 10 has a significant "dwell" portion between ball pockets. This allows the ball to crest the cam without significantly impacting against the cam surface of the next pocket. The dwell furnishes a time interval adequate for the load spring 18 to accelerate the driven cam 16 and balls 15 back to the bottom of the cam pockets and for the motor to decelerate to a lower angular velocity and energy level to insure that if a colision occurs with the next set of ball pockets, the energy imparted would not affect the torque previously transmitted to the fastener. If the balls 15 were allowed to impact against the next cam at a high energy level and at a high slope portion of the cam an undesirable inconsistent torque would result. Because of this a latching mechanism is provided which allows for the lost motion in the tripping device. When the tool is run in the reverse direction the balls must traverse the dwell distance between the pockets of driver cam 10 without shutting off the tool. This may be seen from FIGS. 4, 5, 6 and 7. FIGS. 4 to 7 show the detailed relationship between the cams 10 and 16, cam actuator 9 and plunger 4 for the forward and reverse directions.

Cam actuator 9 allows the necessary lost motion to be realized by having slots 22 cut into it's face into which the driving pins 1 fit. This lost motion device permits the use of cam dwells between the cam surfaces of the cam driver 10.

From the above it is seen that an improved tool is provided in which a ball spline of balls 30 between the driven cam 16 and output spindle 31 provides rolling not sliding movement during disengagement and in which in the forward direction a time dwell is provided to prevent the clutch balls from impacting on the driven cam after air shutoff and before the motor drops to a lower energy level, without additional impact torque. A further feature is the provision of a cam actuator latch which, when operated in the rereverse direction, to prevent the tool from shutting off prematurely. Also, as noted previously, a ball (8) and spring (7) arrangement is provided to prevent the actuator cam from coming to rest in a position which would prevent the tool from resetting.

What is claimed is:

1. In a power tool having a throttle valve to control power to the tool, driving means, selectively operable in either a forward or reverse direction, spindle means adapted for holding a tool, control means, including a valve and an escapement plunger, for turning on and off the driving means, clutch means, including a ball spline, interconnecting the driving means and spindle means, whereby the ball spline transmits rotative force from the clutch to the spindle, and operatively connected to the control means, the said clutch means including driving cam means having a specially designed cam surface with ramps and extended dwell portions, including dwell slack portions, driven cam means having a cam surface with detents and balls intermediate the said driving and driven cam surfaces whereby resistance to movement of the driven cam causes at least one ball to roll up a driving cam ramp to apply torque to the said spindle and activate the said control means to turn off the driving means, the ball then entering the designed dwell portion of the driving cam surface so no further forces are applied to the driven cam after the control means turns off the driving means, the said clutch means including a cam actuator having rise portions and having at least one slot therein, movable by the driving cam, the said cam actuator slot, when rotating in the reverse direction, allowing an angular slack in the movement of the cam actuator by the driving cam so as to provide a dwell time during which the ball rolls without impacting a cam surface and without actuating the said control means escapement plunger, in the absence of resistance to movement.

2. In a pneumatically powered screwdriver, a motor housing, a clutch housing affixed to the motor housing, a valve movable to control flow of pneumatic fluid to the motor housing for operation of a rotary motor therein, in either a forward or reverse direction, a push rod for unseating the valve to allow flow of pneumatic fluid to the motor, a valve spring which is biased to seat the valve to shut off flow of pneumatic fluid to the motor, a clutch member in the clutch housing and rotatably driven by the motor, a spindle in the clutch housing adapted for receipt of a tool shank, a plurality of balls arranged as a ball spline to convey rotary motion from the clutch member to the spindle and a ball compression means urging the balls into engagement with the clutch member, a torque responsive shut-off means for the screwdriver comprising movable means slidingly supported in the spindle and clutch member, compression means biasing said movable means into engagement with the push rod for unseating of the valve, a latch pin arranged in the clutch member, a spring biased for movement of the latch pin into the path of movement of one of said balls, and a lock pin arranged in the clutch member between the latch pin and the movable means for preventing sliding movement of said movable means, said lock pin responsive to movement of said latch pin caused by said one of said balls to release said movable means for sliding movement to enable said valve spring to overcome the bias of said compression means and seat said valve, the said clutch member having a driver cam with an extended dwell portion and a driven cam between which are arranged the said plurality of balls, the cams having ball pockets and a ball ramp over which a ball is forced to rollingly traverse when a predetermined rotational resistance is imposed upon the spindle, the said cams including a dwell portion whereby the clutch balls are prevented from impacting on the driven cam after said valve is seated, preventing air flow, and means including a slotted cam actuator, for preventing the valve from seating prematurely when the motor is rotating in the reverse direction.

3. An adjustable torque control screwdriver tool comprising;

a housing (39) within which are placed, a pneumatic motor (33), a source of air under pressure for driving the motor (33) in either the forward or reverse directions, spring (5), loaded lock pin (6) and control rods (29, 34, 35, and 36), valve means (37) operatively responsive to the said control rods whereby movement of the lock pin (6) moves the said control rods to operate the said valve means for selectively starting and stopping the flow of air under pressure to the motor (33), a gear spindle (38) rotatively driven by the motor (33), a drive coupler (13) arranged to be rotatively driven by the gear spindle (38), a shaped driving cam (10), having an inner diameter and having six raised portions and six pockets including extended dwell portions, each raised portion having two different slope angles, the said driving cam (10) being secured to the driver coupler (13), an output spindle (31) having an outer diameter and having means to accept and retain a bit used to drive a threaded fastener, the said spindle (31) being supported in part by the driving cam (10) by means of balls (11) between the spindle (31) and driving cam (10), adjustable torque means (17-20) for adjusting the amount of torque to be applied to a fastener, a shaped driven cam (16), having an inner diameter and having three pockets, angularly connected to the said output spindle (31) by three equally spaced balls (30) in axial grooves in the inner diameter of the driven cam (16) and the outer diameter of the output spindle (31), the said driven cam (16) being free to move axially relative to the output spindle (31), and abutting the said adjustable torque means, cam balls (15) between the driving cam (10) and the driven cam (16) so arranged that load or resistance to rotation of the spindle (31) acts to resist rotation of the driven cam (16) so that balls (15), between the driving and driven cams, are driven by the driving cam (10) to tend to separate the cams (10) and (16) so as to apply rotative torque to the spindle (31), the balls (15) passing over the raised portions of the driving cam (10) and rolling into a dwell portion of the driving cam surfaces so no further rotative forces are applied to the driven cam after the control means turns off the driving means, a ring (2) restrained slotted cam actuator (9) having a dwell portion, and shaped to fit within the inner diameter of a portion of the driving cam (10) and to be rotated by the cam (10), the rotation of the slotted cam actuator (9) being limited in the degrees of free rotation by driving cam pins (1), which move only within the slotted portion of the slotted cam actuator (9), a cam actuator latch arrangement including a spring (3) and plunger (4) operative in response to the cam actuator (9) when the tool is operating in the reverse mode of operation to take up the ball rolling slack caused by the dwell portion of the actuator cam (9) and the pin (1) moving in the slotted portion of cam (9) so as to prevent premature movement of the lock pin (6) so as to prevent the tool from shutting off prematurely, and a ball (8) and spring (7) arrangement operatively connected to the cam actuator (9) to prevent the cam actuator (9) from coming to rest in a position which might prevent the tool from resetting to its off position where it would be ready to be turned on by pressing the tool against a fastener.

4. In a power tool, operative in either a forward or reverse direction, driving means, spindle means adapted for holding a tool, control means, including a valve and an escaptement plunger (4), for turning on and off the driving means, clutch means interconnecting the driving means and spindle means, and operatively connected to the control means, the said clutch means including driving cam means having a specially designed cam surface with ramps and pockets including extended dwell portions, driven cam means having a cam surface with detents and balls intermediate the said driving and driven cam surfaces whereby resistance to movement of the driven cam causes at least one ball to roll up and over a driving cam ramp to apply torque to the said spindle and activate the said control means to turn off the driving means, the ball then entering the designed extended dwell portion of the driving cam surface so no further forces are applied to the driven cam after the control means turns off the driving means, the said clutch means including a slotted cam actuator (9) having detents, moveable by the driving cam, the slot in the cam actuator allowing an angular slack in the movement of the cam actuator by the driving cam so that, in the reverse direction, a dwell time is provided so the control means escapement plunger is not activated in the absence of resistance to movement, ball (8) and spring (7) apparatus associated with the slotted cam actuator (9) whereby the escapement plunger (4) is urged into a cam actuator (9) detent when stopping so as so assure tool restart by allowing the control means valve to open when the tool is placed against a fastener, no matter where the cams had previously stopped.

* * * * *